US007401410B1

(12) United States Patent
Jewell

(10) Patent No.: US 7,401,410 B1
(45) Date of Patent: Jul. 22, 2008

(54) VIEWFINDER FOR ARTISTS

(76) Inventor: Russell P. Jewell, 116 Deer Creek Ct., Easley, SC (US) 29642

( * ) Notice: Subject to any disclaimer, the term of this patent is extended or adjusted under 35 U.S.C. 154(b) by 184 days.

(21) Appl. No.: 11/448,332

(22) Filed: Jun. 7, 2006

(51) Int. Cl.
*B43L 13/00* (2006.01)

(52) U.S. Cl. ..... 33/1 K; 33/18.3

(58) Field of Classification Search ..... 33/1 G, 33/1 K, 1 BB, 18.3, 298
See application file for complete search history.

(56) References Cited

U.S. PATENT DOCUMENTS

| | | | | |
|---|---|---|---|---|
| 216,460 | A | 6/1879 | Rosquist | |
| 223,569 | A | 1/1880 | White | |
| 822,633 | A | 6/1906 | Schrick | |
| 1,621,991 | A * | 3/1927 | Mayer | 396/563 |
| 1,622,229 | A * | 3/1927 | Ormiston | 33/1 K |
| 2,193,518 | A | 3/1940 | Lubin | |
| 2,881,544 | A | 4/1959 | Knox | |
| 3,660,903 | A * | 5/1972 | Caperton, Jr. | 33/276 |
| 4,177,573 | A * | 12/1979 | Boston, III | 33/277 |
| 4,820,163 | A | 4/1989 | McCarty | |
| 5,247,744 | A | 9/1993 | Ferris et al. | |
| 6,154,968 | A | 12/2000 | Andre | |
| 6,579,099 | B1 | 6/2003 | Pipes, Jr. | |
| 6,751,878 | B2 | 6/2004 | Hamann | |
| 6,769,190 | B2 | 8/2004 | Carlisle | |

OTHER PUBLICATIONS

The Color Wheel Company, ViewCatcher The Artist Tool that Teaches, Aug. 2003, United States.

* cited by examiner

*Primary Examiner*—G. Bradley Bennett
(74) *Attorney, Agent, or Firm*—J. Bennett Mullinax, LLC

(57) ABSTRACT

A viewfinder for aiding an artist in the creation of a work of art is provided. The viewfinder includes a frame that carries a first door. The first door is configured for moving with respect to the frame. A second door is provided and is also carried by the frame. The second door is configured for being moved with respect to the frame. At least one of the first door, second door and frame define a subject area for use in the creation of a work of art. Other exemplary embodiments exist that include a light filter, reducing lens and/or a grid.

19 Claims, 7 Drawing Sheets

VIEWFINDER FOR ARTISTS

FIELD OF THE INVENTION

The present invention relates generally to a viewfinder that provides an artist with artistic information when creating a work. More particularly, the present application involves a viewfinder that may give the artist the ability to crop, reduce, filter and grid an image in order to assist the artist when creating a work.

BACKGROUND

The creation of works of art, such as through painting or drawing, is a common commercial and leisure activity. An artist often creates a work while viewing a particular subject either in his or her studio or outdoors. Various techniques are known for aiding the artist in creation of a particular work.

One method of assisting artists involves the use of a sighting grid. Such grids generally include a plurality of intersecting horizontal and vertical lines. The artist may view an image through the grid as the areas between the intersecting horizontal and vertical lines are either open or are made of a transparent material. Next, the artist can apply a similarly proportioned grid to the drawing or painting surface. The artist may more easily paint or draw the image onto the working surface as the grid breaks the image up into smaller, more manageable portions. Further, the grid assists the artist in visualizing three dimensional form and perspective as a two dimensional shape for a better result upon transfer of the image to the working surface.

Another technique used by artists is employed when an artist desires to reproduce the natural color of an image while working in a color medium. In order to accurately reproduce the color of such an image the artist must determine the value of the image. The value of the image refers to the amount of light reflectance from the image and, as such, may be described as its level of lightness or darkness. A known method of ascertaining the value of the studied image involves viewing the image through a light filter such as a green light filter. The green light filter may be a piece of green, transparent plastic that acts to turn the various colors of the viewed image into shades of green. Upon creation of such a monotone image, the artist may more easily distinguish the various values of the colors for use in making a more accurate reproduction on the working surface.

An additional method used by artists in the creation of a work involves framing of the image. Here, the artist uses an object such as a viewing frame to better visualize how the image will look once put onto the working surface. The frame acts to block out undesired objects in the artist's field of vision and hence allows the artist to better concentrate on the desired subject. Upon the absence of a frame, the artist may use his or her fingers to frame the image. Although useful when creating a work of art from a photograph, the use of a frame is especially helpful when making a plein air painting as the artist's vision is normally overloaded from the surrounding environment.

Although previous devices are known for aiding an artist in the creation of a work, they are limited to assisting with only one technique. Further, other devices are cumbersome and do not optimize the particular employed method of assisting the artist. As such, there remains room for variation and improvement within the art.

SUMMARY

Various features and advantages of the invention will be set forth in part in the following description, or may be obvious from the description, or may be learned from practice of the invention.

The present invention provides for a viewfinder that has a frame and a first door carried by the frame. The first door is configured for being moved with respect to the frame. A second door is carried by the frame and is likewise configured for being moved with respect to the frame. At least one of the first door, second door and frame define a subject area for use in creation of a work of art.

The present invention also provides for a viewfinder as immediately discussed in which the first door and second door are opaque.

Also provided in accordance with the present invention is a viewfinder as discussed above in which the first door slides in a first direction with respect to the frame. The second door slides in a second direction with respect to the frame. The first direction and second direction are oriented at a ninety degree angle to one another.

Another exemplary embodiment of the invention exists in a viewfinder as previously mentioned that further includes a reducing lens carried by the frame. The reducing lens is configured to reduce the size of an image so that the image viewed in the subject area is reduced as compared to the size of the image viewed outside of the subject area.

Also provided in accordance with one exemplary embodiment is a viewfinder as discussed above that further includes a light filter carried by the frame. The light filter is configured for filtering out wavelengths of light from an image in order to more easily distinguish the color value of the image viewed in the subject area.

The present invention also provides for a viewfinder that has a frame that defines a window. A first door is present and is carried by the frame and is configured for being moved with respect to the frame. The first door is positionable with respect to the frame so as to obstruct viewing through the window. A second door is present and is likewise carried by the frame and configured for being moved with respect to the frame. The second door is positionable with respect to the frame so as to obstruct viewing through the window. The viewfinder also includes a reducing lens that is carried by the frame. The reducing lens is configured to reduce the size of an image viewed through the window as compared to the size of the image viewed outside of the window.

An additional aspect of the present invention exists in a viewfinder as immediately discussed that further includes a light filter carried by the frame. The light filter is configured for being moved with respect to the frame. The light filter is positionable with respect to the frame so as to be configured for filtering out wavelengths of light from the image viewed through the window so as to more easily distinguish the color value of the image viewed through the window.

Another exemplary embodiment of the present invention exists in a viewfinder as described above that also includes a first transparent door that is carried by the frame. The first transparent door has a linear edge and is configured for being moved with respect to the frame. A second transparent door is also present and is likewise carried by the frame. The second transparent door has a linear edge and is configured for being moved with respect to the frame. The first and second transparent doors are configured to be positioned with respect to one another so that the linear edges of the first and second transparent doors create a grid in the subject area or window.

An additional aspect of the present invention resides in a viewfinder as described above that further includes a transparent grid door that is carried by the frame and configured for being moved with respect to the frame. The transparent grid door has a plurality of grid lines for creating a grid in the subject area or window.

Also provided in accordance with one aspect of the present invention is a viewfinder with a frame that has a window for use by a user in viewing an image therethrough. A reducing lens is carried by the frame and is disposed in the window. The reducing lens is configured to reduce the size of an image viewed through the window as compared to the size of the image viewed outside of the window. A grid is present and is carried by the frame. The grid is configured for being moved with respect to the frame so as to be positionable in the window.

In yet another aspect of the present invention a viewfinder as immediately discussed is provided in which the grid has a first transparent door. The first transparent door is carried by the frame and is configured for being moved with respect to the frame. A second transparent door is carried by the frame and is likewise configured for being moved with respect to the frame. Both the first and second transparent doors each have a linear edge. Further, the first and second transparent doors are configured to be positioned with respect to one another so that their linear edges create the grid in the window.

Also provided in accordance with the present invention is a viewfinder as immediately discussed in which the first transparent door slides in a first direction with respect to the frame. The second transparent door slides in a second direction with respect to the frame. The first direction and the second direction are oriented at a ninety degree angle to one another.

The present invention also provides in one aspect a viewfinder as discussed above in which the grid is a transparent grid door carried by the frame. The transparent grid door is configured for being moved with respect to the frame and has a plurality of grid lines for creating a grid in the window.

Another aspect of the present invention resides in a viewfinder as discussed above that further includes a red light filter that is carried by the frame. The red light filter is configured for being moved with respect to the frame so as to be positionable in the window. The red light filter is configured for filtering out wavelengths of light from the image so as to more easily distinguish the color value of the image viewed in the window.

These and other features, aspects and advantages of the present invention will become better understood with reference to the following description and appended claims. The accompanying drawings, which are incorporated in and constitute part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended Figs. in which.

Figure 1:
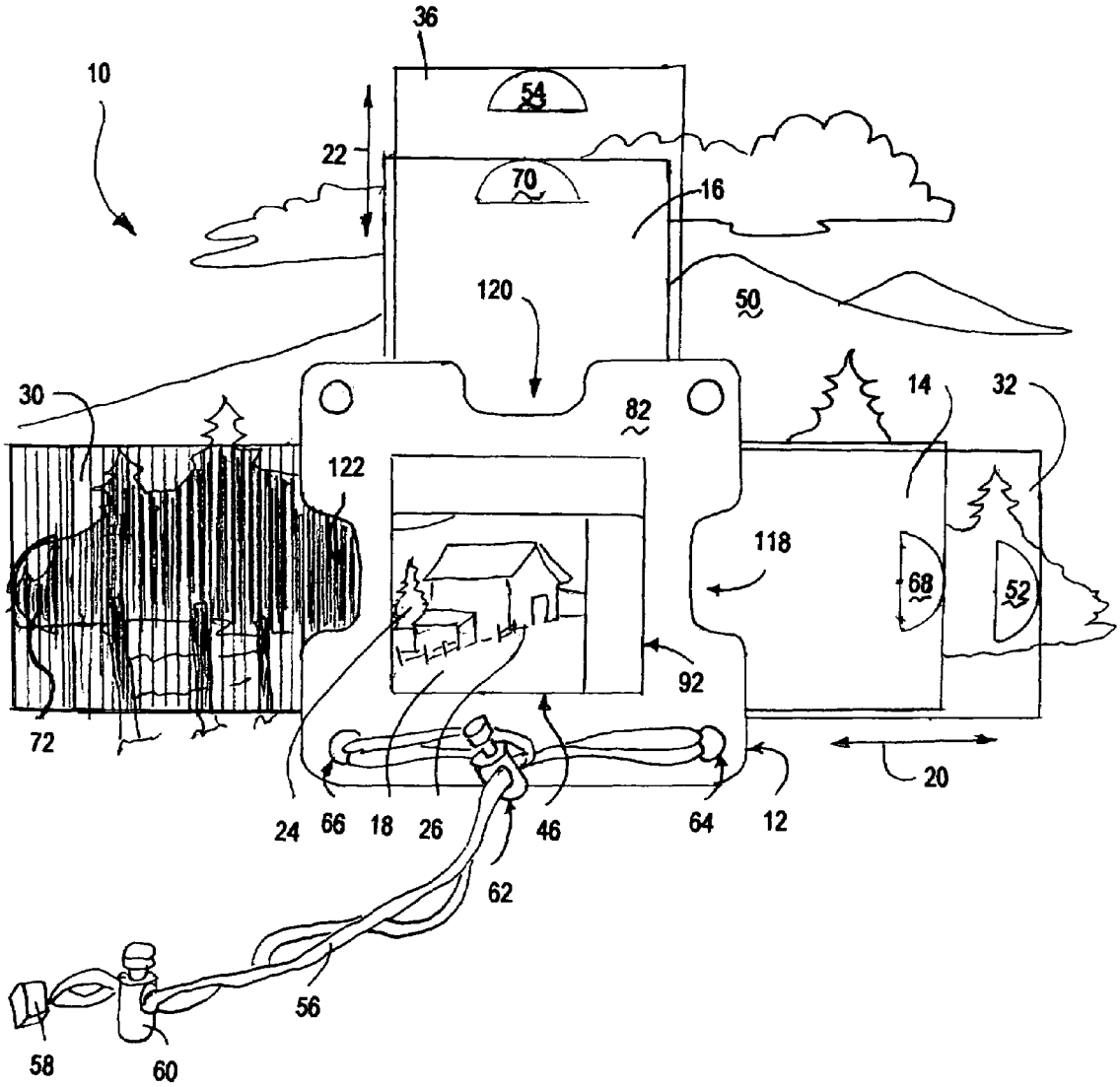
FIG. 1 is a front view of a viewfinder for use in creating a drawing or painting of a landscape in accordance with one exemplary embodiment of the present invention.

Repeat use of reference characters in the present specification and drawings is intended to represent the same or analogous features or elements of the invention.

DETAILED DESCRIPTION OF REPRESENTATIVE EMBODIMENTS

Reference will now be made in detail to embodiments of the invention, one or more examples of which are illustrated in the drawings. Each example is provided by way of explanation of the invention, and not meant as a limitation of the invention. For example, features illustrated or described as part of one embodiment can be used with another embodiment to yield still a third embodiment. It is intended that the present invention include these and other modifications and variations.

It is to be understood that the ranges mentioned herein include all ranges located within the prescribed range. As such, all ranges mentioned herein include all sub-ranges included in the mentioned ranges. For instance, a range from 100-200 also includes ranges from 110-150, 170-190, and 153-162. Further, all limits mentioned herein include all other limits included in the mentioned limits. For instance, a limit of up to about 7 also includes a limit of up to about 5, up to about 3, and up to about 4.5.

The present invention provides for a viewfinder 10 that is used to aid an artist in creation of a work of art. The artist directs the viewfinder 10 towards an image 50 such as a landscape, object or photograph. The viewfinder 10 includes various elements that act to crop, reduce, filter and/or grid the image 50 so that a resulting image 26 is viewed in a window 46 of the viewfinder 10 by the artist. The artist may use the resulting image 26 in order to more easily or more accurately create a work of art.

FIG. 1 shows one embodiment of the viewfinder 10. The viewfinder 10 may be used when creating a plein air painting such that the image 50 is a landscape. However, it is to be understood that the image 50 that is the subject of the artist's painting or drawing need not be a landscape. In these instances, the viewfinder 10 can be used to assist the artist when painting or drawing a photograph or an object in the artist's studio. The viewfinder 10 includes a frame 12 that defines a window 46. The artist looks into the window 46 in order to view an image 26 that is modified from the actual image 50. The artist gains beneficial artistic information upon viewing the modified image 26 for use in preparing a work of art.

The viewfinder 10 includes a first door 14 and a second door 16 that are carried on the frame 12. The frame 12 is made of one or more elements that are capable of carrying other elements of the viewfinder 10. The doors 14 and 16 can move with respect to the frame 12 so as to be positionable therewith. In the exemplary embodiment shown, the doors 14 and 16 are in sliding engagement with the frame 12. However, in other exemplary embodiments, the doors 14 and 16 need not be in sliding engagement with frame 12 but may move in other manners. For instance, the doors 14 and 16 can pivot with respect to frame 12, or the doors 14 and 16 can be detachable from the frame 12. The doors 14 and 16 are opaque and do not allow any light to pass therethrough. In this regard, the surface of the doors 14 and 16 can be solid so that they do not contain any apertures for light to pass through. The doors 14 and 16 may be of the same or different color than the frame 12.

The viewfinder 10 can be used to frame the image 50 so that the artist sees only the elements desired for inclusion in his or her work while other, extraneous elements are blocked from view. The first and second doors 14 and 16 can be fully extended so that they are moved completely out of and do not block viewing through any portion of the window 46. In this configuration, the frame 12 defines the entire subject area 18 and helps the artist more easily visualize the image 26 that is to be transferred to the working surface. The window 46 can be completely surrounded by the frame 12, or window 46 may be opened at one or more locations. The first door 14 is configured to move in a first direction 20, and the second door 16 is configured for moving in a second direction 22. The first and second directions 20 and 22 may be oriented at a ninety degree angle to one another, although it is to be understood that in other exemplary embodiments that they may be oriented at various angles. For example, the first and second directions 20 and 22 may be oriented at an angle ranging from forty five to one hundred and twenty degrees in other exemplary embodiments.

In FIG. 1, the first direction 20 is the horizontal direction and the second direction 22 is the vertical direction. The first door 14 is positioned with respect to the frame 12 so that a portion of the first door 14 is located in the window 46. Likewise, the second door 16 is positioned with respect to frame 12 so that it is at least partially located in window 46. A portion of the window 46 is blocked as the first and second doors 14 and 16 are opaque. The frame 12, first door 14 and second door 16 define the subject area 18 that is of interest to the artist and is used in the creation of a work. It is to be understood, however, that in other embodiments the frame 12, first door 14 and second door 16 need not all be used in forming subject area 18. For example, the subject area 18 may be formed by only the frame 12 and the first door 14. Alternatively, only frame 12 and second door 16 may be used to form subject area 18 if desired. The doors 14 and 16 allow for cropping of the image 50 so that the image 26 viewed in the subject area 18 is the image desired to be transferred to the working surface. The artist can position the doors 14 and 16 in a variety of manners with respect to the frame 12 so that the subject area 18 can be defined in a number of different sizes and shapes. Although shown as employing two doors 14 and 16, it is to be understood that any number of doors may be employed in other embodiments. For example, from zero to five doors may be employed.

Figure 2:
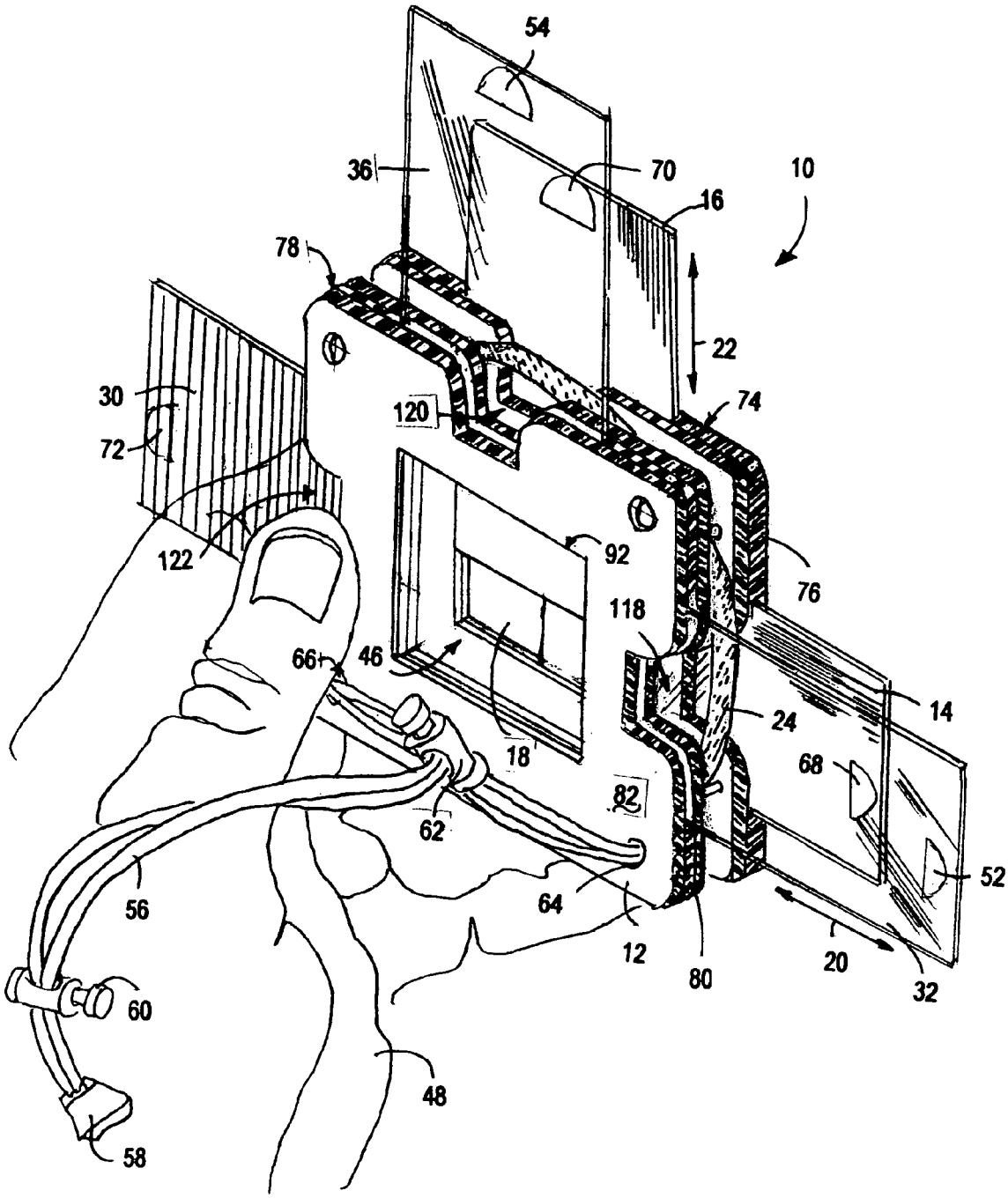
FIG. 2 is a perspective view of the viewfinder of FIG. 1 held by a user.
Figure 3:
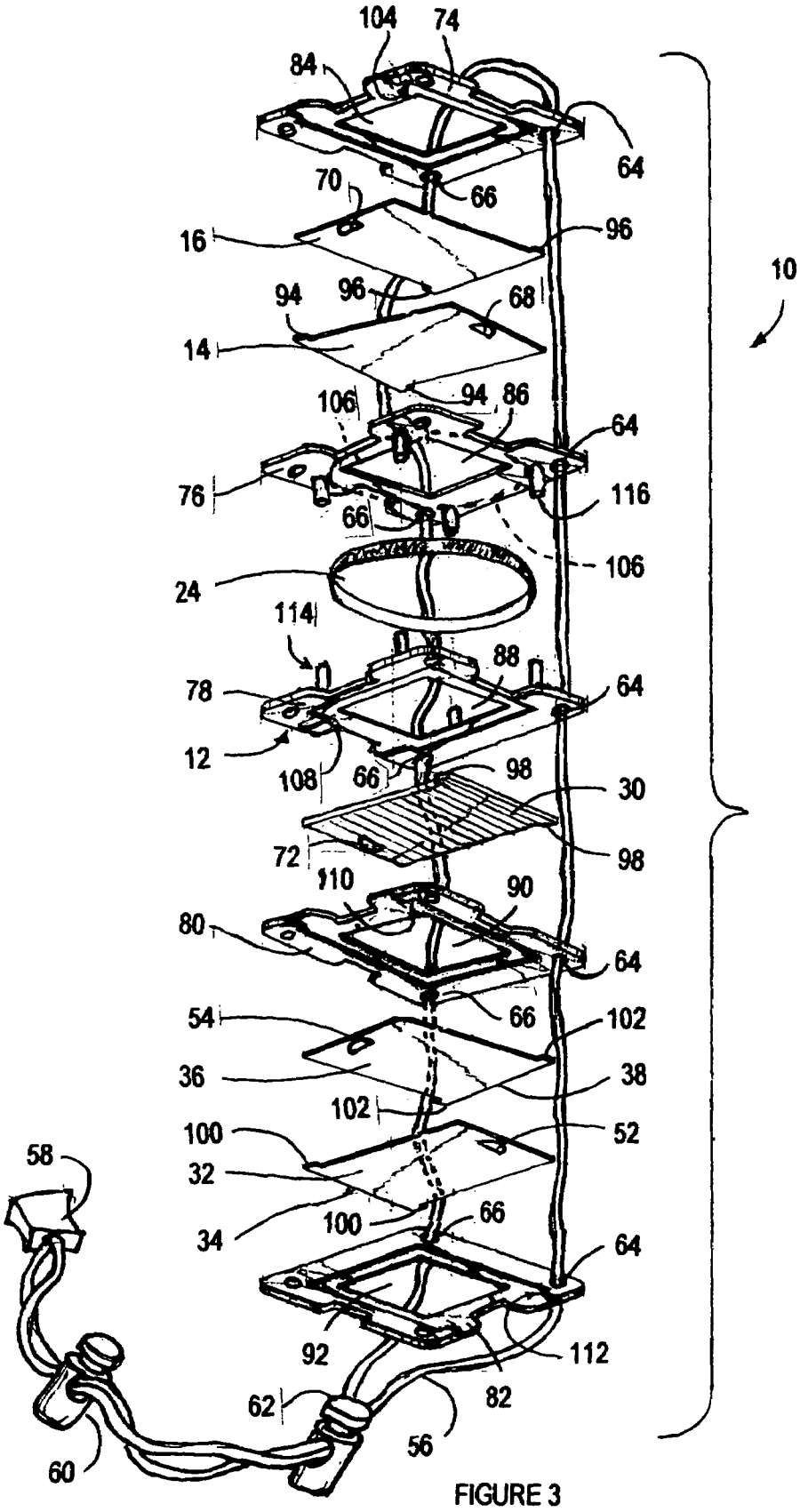
FIG. 3 is an exploded assembly view of the viewfinder of FIG. 1.

The viewfinder 10 also employs a reducing lens 24 as may be more easily seen in FIGS. 2 and 3. The size of an image is reduced when viewed through the reducing lens 24. The reducing lens 24 functions to improve the artist's field of vision through a reduction in the size of the viewed image. The reducing lens 24 allows the artist to view a smaller, more compact view of the subject image 50 that thus aids the artist in creating his or her work. The reducing lens 24 can be a concave lens in one exemplary embodiment. As shown in FIG. 2, the reducing lens 24 is incorporated into the viewfinder 10 so as to be stationary with respect to the frame 12. However, other embodiments are possible in which the reducing lens 24 may move with respect to frame 12. For example, the reducing lens 24 can pivot or slide with respect to frame 12, or the reducing lens 24 can detach from frame 12.

FIG. 1 shows the viewfinder 10 with the reducing lens 24 so that the image 26 in the subject area 18 is reduced as compared to the image 50 outside of the subject area 18. In this regard, an object viewed by the artist without looking through the viewfinder 10 with the reducing lens 24 looks larger than the same object viewed through the viewfinder 10 with the reducing lens 24. The reducing lens 24 can be provided so as to reduce the image 50 any desired amount. For example, the image 26 in subject area 18 may be 25%, 50%, 75% or 90% of the size of the same image 50 when viewed outside of the subject area 18.

Figure 4:
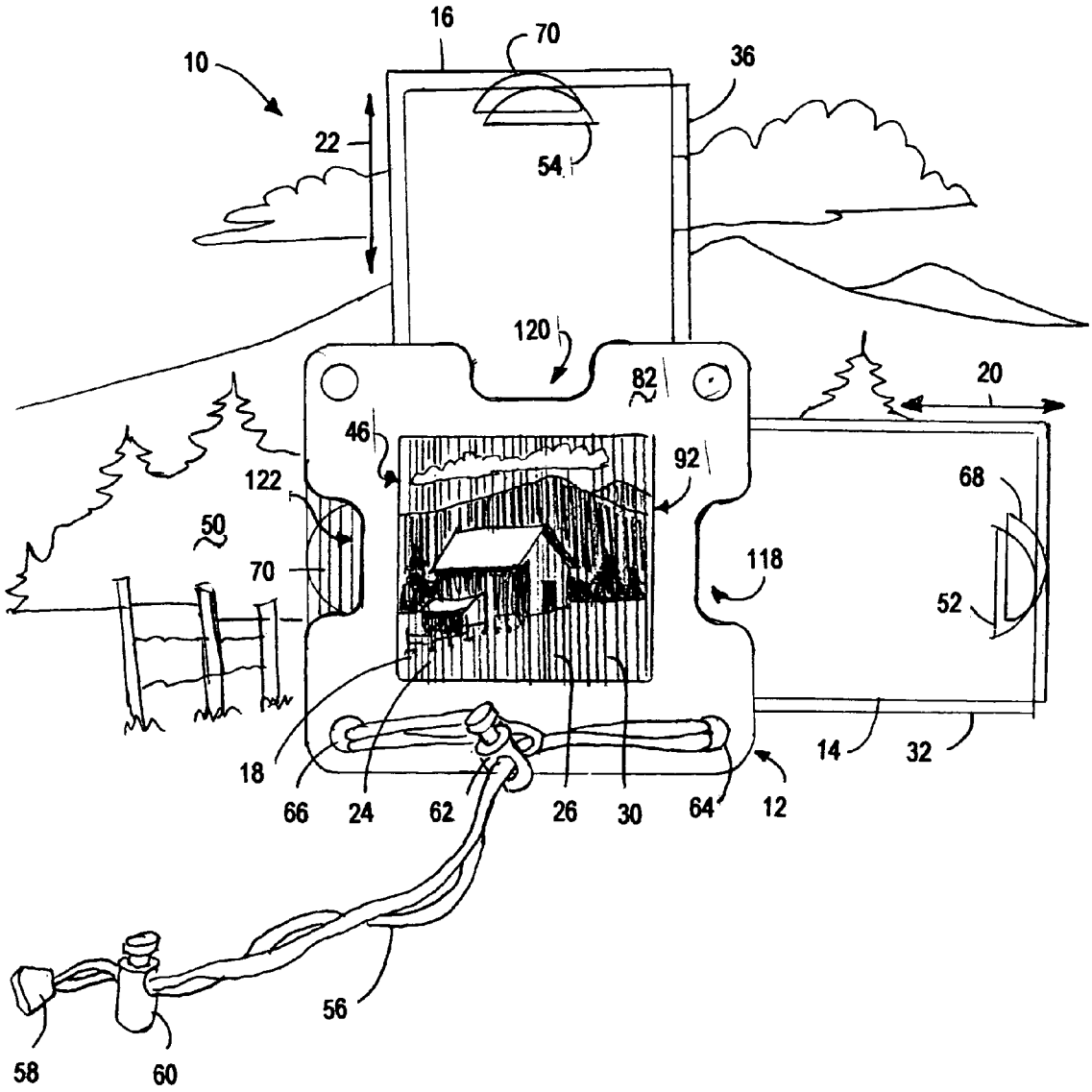
FIG. 4 is front view of the viewfinder of FIG. 1 in which the viewed image is both reduced in size and filtered.

The viewfinder 10 may also include a light filter 30. The light filter 30 may be carried by the frame 14 and can be movable therewith. As with previously described components, the light filter 30 can slide or pivot with respect to the frame 14, or the light filter 30 may be detachable from the frame 14. As shown in FIG. 1, the light filter 30 is moved with respect to the frame 14 so as to be positioned completely out of the window 46 so that the viewed image 26 is not affected by the light filter 30. FIG. 4 shows a configuration of the viewfinder 10 in which the light filter 30 is positioned with respect to frame 12 so as to be positioned in window 46. The light filter 30 is a colored, transparent material that acts to block certain wavelengths of light from passing. The light filter 30 can be made of a colored piece of plastic. For example, the light filter 30 is made of a red transparent piece of plastic in the exemplary embodiment shown. However, it is to be understood that the light filter 30 may be variously configured in other exemplary embodiments. For instance, the light filter 30 can be made of green transparent plastic or of green transparent glass in other embodiments.

The light filter 30 renders the value of the image 26 to the artist. In the embodiment shown, the light filter 30 turns the image 26 to various shades of red. Creation of a monotone image 26 allows the artist to more easily distinguish the values of the colors need in creating the work of art. Upon creation of such a monotone image, the artist may more easily distinguish the various values of the colors for use in making a more accurate reproduction on the working surface. The image 26 in the window 46 in FIG. 4 is also reduced in size from its original size of image 50 by the reducing lens 24.

An additional technique that is helpful to artists when creating a drawing or painting involves the use of a grid 40. With this method, a grid is superimposed over the image 50. The grid can be made of a plurality of intersecting horizontal and vertical lines which act to break the image 50 up into a number of smaller segments. A grid with identically configured intersecting horizontal and vertical lines is then placed onto the working surface. The artist may then more easily and/or accurately transfer the image 50 onto the working surface as the image 50 has been broken up into smaller, more manageable portions. The grid placed onto the working surface may be sized proportionately larger or smaller than the grid superimposed over the image 50. Although described as being made of intersecting horizontal and vertical lines, the grid can have lines provided in different orientations so that they intersect to form variously shaped triangles, hexagons and/or quadrilaterals.

Figure 5:
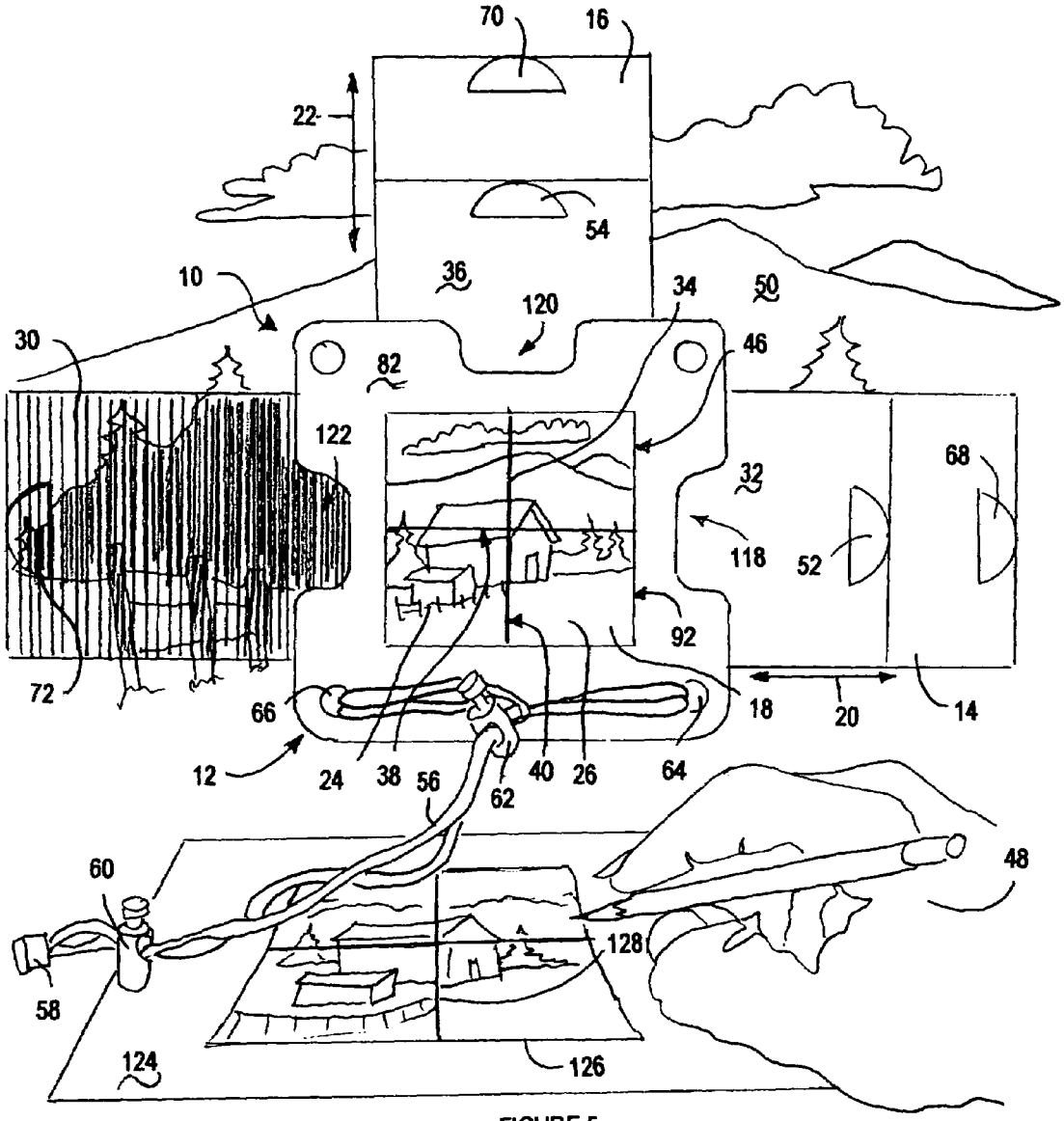
FIG. 5 is a front view of the viewfinder of FIG. 1 in which the viewed image is both reduced in size and has a grid applied thereto.

The viewfinder 10 includes a first transparent door 32 and a second transparent door 36 that are used to make the grid 40. FIG. 5 shows the viewfinder 10 in which the first door 14, second door 16 and light filter 30 are positioned out of the window 46. The first and second transparent doors 32 and 36 can be moved with respect to frame 12 in the same manners as discussed earlier with respect to the doors 14 and 16. As shown, the first and second transparent doors 32 and 36 are configured to slide with respect to frame 12. The direction of movement of the first transparent door 32 is oriented at a ninety degree angle to that of the second transparent door 36. The first transparent door 32 has a linear edge 34 that is opposite a handle portion 52, and the second transparent door 36 has a linear edge 38 that is opposite handle portion 54. The first and second transparent doors 32 and 36 can be positioned with respect to the frame 12 so that their linear edges 34 and 38 are located in the window 46. As the direction of orientation of the linear edges 34 and 38 is ninety degrees to one another, the linear edges 34 and 38 act to create a visible cross-hair in the window 46 and thus form the grid 40. As the first and second transparent doors 32 and 36 are movable with respect to the frame 12, the center of grid 40 can be located at any position in window 46. The linear edges 34 and 38 thus act to break the image 26 into four quadrants to aid the artist in creation of his or her work. In accordance with other exemplary embodiments, several transparent doors may be employed in order to create variously configured grids 40 in window 46. For example, up to six transparent doors may be used to form grid 40 in accordance with other exemplary embodiments of the present invention. With respect to FIG. 5, the image 26 viewed by the artist in window 46 is reduced in size from original image 50 due to the presence of the reducing lens 24 and is also superimposed with grid 40. The first and second transparent doors 32 and 36 may be made of transparent plastic or glass.

The first and second transparent doors 32 and 36 are shown in a completely extended position in the exemplary embodiment shown in FIGS. 1 and 2. In practice, the artist may keep the doors 32 and 36 closed as they are transparent and allow the image 50 to be viewed. The doors 32 and 36 are shown in their extended, open position in FIGS. 1 and 2 for sake of clarity. However, it is to be understood that the artist may keep the doors 32 and 36 extended if desired.

The artist may direct the viewfinder 10 to the working surface once he or she obtains the image 26 in the window 46. The grid 40 will then be superimposed over the working surface in the window 46. The artist can move the viewfinder 10 closer or further from his or her eyes in order to obtain the desired size of the area to be drawn or painted. Next, the artist can mark the corners and the grid midpoints of the desired frame on the working surface. One example of a working surface 124 is shown in FIG. 5. The artist may create markings for a frame 126 and crosshair 128 on the working surface 124 that is in direct proportion to the image 26 viewed in window 46 of the viewfinder 10. The artist may begin to draw or paint objects that lie directly on the frame 126 or crosshair 128 lines first. By first drawing these objects in proportion the artist may be able to more easily draw other objects onto the working surface 124 that do not touch the boundary lines.

Figure 6:
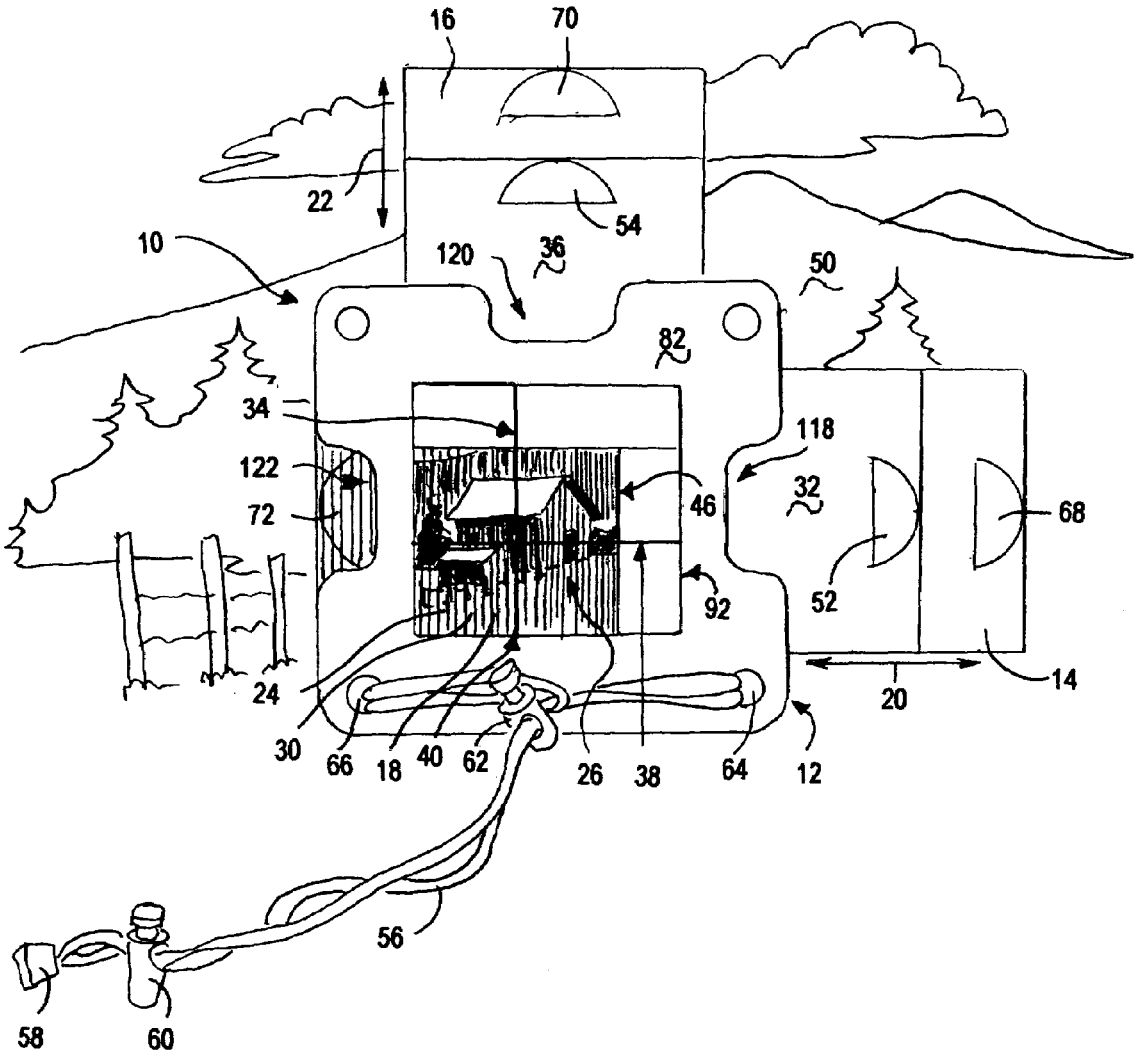
FIG. 6 is a front view of the viewfinder of FIG. 1 in which the viewed image is cropped, reduced in size, filtered and has a grid applied thereto.

The viewfinder 10 includes a number of components that can be utilized by the artist to obtain information when preparing a work of art. The aforementioned components may be utilized all at once or individually depending upon the particular needs of the artist. FIG. 6 shows a configuration of the viewfinder 10 in which all of the components are used at the same time to form the resulting image 26. As shown, the first and second doors 14 and 16 are positioned with respect to window 46 in order to crop image 50 and thus aid the artist in focusing on the image 26 of interest. The reducing lens 24 is also present and acts to reduce the size of image 26 as compared to the size of image 50 outside of the window 46. The light filter 30 is positioned with respect to frame 12 so as to be present in window 46 and thus filter image 26 so that it is seen by the artist in different shades of red. Finally, the first and second transparent doors 32 and 36 are positioned with respect to frame 12 so that grid 40 is superimposed on image 26. Such a configuration of the viewfinder 10 allows all of the various artistic tools to be implemented at the same time. However, the artist may if desired chose to use any number of the aforementioned tools one at a time instead of all at once. Further, although described as having components that allow the image 50 to be cropped, reduced, filtered and have a grid placed thereon, it is to be understood that the viewfinder 10 may be provided so as to have fewer than all of these capabilities. For example, the viewfinder 10 may be constructed to be capable of only cropping or filtering the image 50. Alternatively, the viewfinder 10 can be made so that only reducing and placing a grid onto the image 50 is possible. Further exemplary embodiments exist in which any number of the aforementioned capabilities are possible.

Figure 7:
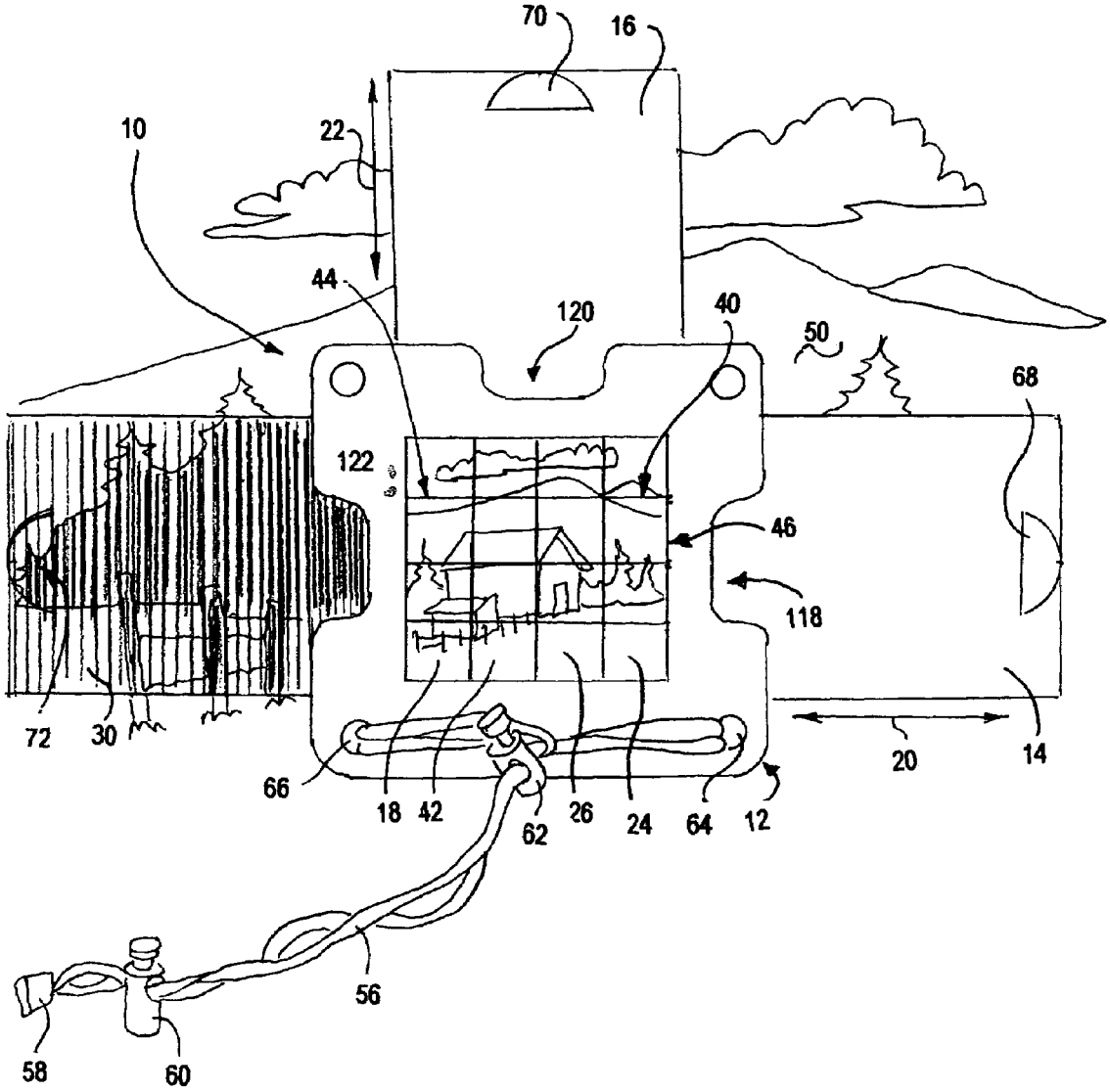
FIG. 7 is a front view a viewfinder in accordance with another exemplary embodiment of the present invention in which a grid is formed by having a plurality of grid lines present on a transparent door.

FIG. 7 is a front view of the viewfinder 10 in accordance with an alternative exemplary embodiment of the present invention. The viewfinder includes first door 14, second door 16, reducing lens 24 and light filter 30 as described above in the previous exemplary embodiment. However, the viewfinder 10 does not include the first transparent door 32 and the second transparent door 36. Instead, a transparent grid door 42 is present and is carried by the frame 12. The transparent grid door 42 is movable with respect to the frame 12 so that it may be moved into and out of the window 46. The transparent grid door 42 is made of a transparent material such as plastic or glass. A plurality of grid lines 44 are present on the transparent grid door 42. the grid lines 44 can be provided thereon in a number of different manners. For example, the grid lines 44 can be etched, printed or engraved onto the transparent grid door 42. Further, the grid lines 44 may be a structure, such as a wire frame, that is formed inside of or on the surface of the transparent grid door 42.

The grid lines 44 intersect one another and are arranged in a vertical and horizontal orientation. A grid 40 is superimposed on image 26 when the transparent grid door 42 is positioned in window 46. The artist can use the grid 40 formed by the transparent grid door 42 in the same manner as the grid 40 formed in connection with the first and second transparent doors 32 and 36 previously discussed. Although shown as being vertical and horizontal in nature, the grid lines 44 may be variously configured in other embodiments. For example, the grid lines 44 may form triangles, hexagons, quadrilaterals or other shapes in other embodiments of the viewfinder 10.

Referring to FIG. 2, the viewfinder 10 includes a drawstring 56 that is looped through apertures 64 and 66 of frame 12. The drawstring 56 can be used to help hold the viewfinder 10. For example, the viewfinder 10 can be held around the neck of the artist or around an easel by use of the drawstring 56. An end cap 58 is present at the end of the drawstring 56 in order to hold the two cords of the drawstring 56 together. A drawstring stopper 60 is present on the drawstring 56 and is proximate to the end cap 58. The drawstring stopper 60 may be used for mounting the viewfinder 10 onto an easel. An additional drawstring stopper 62 is also present and is used for adjusting the size of a loop formed by the drawstring 56 proximate to the frame 12. The drawstring 56 can be made of an elastic material in certain embodiments of the present invention. The viewfinder 10 is shown as being of a size small enough to be held by the hand 48 of the artist. In this manner, the viewfinder 10 can be a relatively compact instrument that can be easily transported and used in the field by the artist. In other embodiments, the viewfinder 10 may be a larger object that is not capable of being held by the hand 48 of the artist but must instead be placed onto an easel or other mounting structure for use.

FIG. 3 shows an exploded assembly view of the viewfinder 10. The frame 12 can be constructed in a variety of manners in accordance with various exemplary embodiments of the present invention. For example, the frame 12 may be a single component that carries the variously described functional elements such as the first door 12, second door 16 and reducing lens 24. Alternatively, the frame 12 may be made of multiple sections attached to one another that carry the functional elements. The frame 12 may be made of a variety of materials. For instance, the frame 12 can be made of opaque plastic in accordance with one exemplary embodiment.

FIG. 3 shows the frame 12 being made up of a variety of sections. Section 74 is present and defines an aperture 84 which in turn makes up part of the window 46. Section 74 also has a recessed area into which the second door 16 is inserted. The second door 16 has a pair of tabs 96 that slide along the inner surface of the recessed area and contact an edge 104 of section 74. The second door 16 is thus prevented from exiting the section 74 through the interaction of tabs 96 and edge 104. The tabs 96 can be configured differently in other embodiments. For example, the tabs 96 can be spring type elements that are urged against the side of the recessed area of section 74 and act to "lock" the second door 16 into position when completely covering the aperture 84. The second door 16 may also include a crescent shaped handle 70 on an end opposite that of the tabs 96. Handle 70 can be provided on both sides of the second door 16 in order to allow the artist to more easily grasp the second door 16 and move it into a desired position.

Section 76 is contiguous with section 74 and includes a recessed area for receiving the first door 14. The first door 14 has a pair of tabs 94 and edge 106 whose arrangement and function may be the same as tabs 96 and edge 104 described above in relation to the second door 16. Section 76 has an aperture 86 that makes up part of the window 46 and is aligned with aperture 84. The first door 14 can be grasped by handle 68 and moved into and out of position so as to cover various portions of aperture 86 and hence window 46. Sections 74 and 76 can be attached to one another through any means commonly known in the art. For instance, sections 74 and 76 can be attached through adhesion, mechanical fasteners or welding in various embodiments.

Section 78 defines an aperture 88 and edge 108 and is configured in a similar manner to sections 74 and 76 with respect to housing the light filter 30. Light filter 30 likewise has tabs 98 and handle 72 that can be arranged and function in the same manner as those discussed above with respect to the first door 14. On an opposite side from the light filter 30, section 78 contacts the reducing lens 24 that likewise contacts section 76. Reducing lens 24 is of circular shape and does not move with respect to section 78 in the exemplary embodiment shown. A plurality of pegs 114 surround reducing lens 24. Pegs 114 are inserted into respective receiving members 116 present on section 76. Reducing lens 24 may be force fit between the pegs 114 and receiving members 116, or reducing lens 24 can be located between these components but not retained though engagement therewith. Engagement between the pegs 114 and receiving members 116 can be tight enough to cause a friction fit so as to effect attachment between sections 78 and 76. Adhesives, mechanical fasteners or other means of attachment may be employed to hold sections 78 and 76 to one another. Reducing lens 24 can be held between sections 78 and 76 so to prevent its movement.

The side of section 80 opposite reducing lens 24 holds the second transparent door 36. As with previously described sections, section 80 defines an aperture 90 and an edge 110. A recess is present for receiving the second transparent door 36 which includes tabs 100 and handle 52. The aforementioned components can function in a manner similar to those discussed above with respect to other elements such as the second door 16 and section 74.

Section 82 is provided and is in contact with section 80. Section 82 defines an aperture 92 and an edge 112 and holds the first transparent door 32. Sections 80 and 82 can be attached to one another through any known means such as adhesion, mechanical fasteners or welding. The first transparent door 32 includes tabs 100 and handle 52 that function in a similar manner and that can be arranged as tabs 96 and handle 70 as previously mentioned. As with apertures 84, 86, 88 and 90, aperture 92 makes up part of the window 46 which allows the artist to see through the viewfinder 10. Although described as being composed of a plurality of linearly arranged apertures 84, 86, 88, 90 and 92, it is to be understood that the window 46 can be variously arranged in other embodiments. For example, the window 46 need not have a series of apertures but may instead included a mirror or other component that allows the artist to view the cropped, reduced, filtered or grid superimposed image 26.

The sections 74, 76, 78, 80 and 82 can be arranged and sized so that sufficient space is available for the artist to grasp the doors 14, 16, 32, 36 and light filter 30 in order to position them to a desired location on the frame 12. FIG. 2 shows a plurality of recesses 118, 120 and 122 defined in frame 12 to afford the artist access to the previously mentioned components. However, in other embodiments, recesses 118, 120 and 122 need not be present. Additionally, in other embodiments additional framing elements may be present along the sides of the sections 74, 76, 78, 80 and 82 in order to conceal certain portions of the interior of frame 12 and to potentially aid in keeping the sections held together. These framing sections are not shown in the drawings of the present application for sake of clarity. Further, although described as being attached sequentially to one another, it is to be understood that the sections 74, 76, 78, 80 and 82 can be retained onto one another to form frame 12 in a variety of manners. For example, the drawstring 56 can be used to hold these components together to form frame 12.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. A viewfinder, comprising:

a frame;

a first door carried by said frame and configured for being moved with respect to said frame;

a second door carried by said frame and configured for being moved with respect to said frame;

wherein at least one of said first door, said second door and said frame define a subject area for use in creation of a work of art;

a first transparent door carried by said frame and configured for being moved with respect to said frame, said first transparent door having a linear edge; and a second transparent door carried by said frame and configured for being moved with respect to said frame, said second transparent door having a linear edge;

wherein said first and second transparent doors are configured to be positioned with respect to one another so that said linear edges of said first and second transparent doors overlay and cross one another so as to create a grid in said subject area.

2. The viewfinder as in claim 1, wherein said first door and said second door are opaque.

3. The viewfinder as in claim 1, wherein said first door slides in a first direction with respect to said frame, wherein said second door slides in a second direction with respect to said frame, and wherein said first direction and said second direction are oriented at a ninety degree angle to one another.

4. The viewfinder as in claim 1, further comprising a reducing lens carried by said frame, said reducing lens configured to reduce the size of an image such that the image viewed in said subject area is reduced as compared to the size of the image viewed outside of said subject area.

5. The viewfinder as in claim 1, further comprising a light filter carried by said frame, said light filter configured for filtering out wavelengths of light from an image so as to more easily distinguish the color value of the image viewed in said subject area.

6. The viewfinder as in claim 5, wherein said light filter is a red light filter.

7. The viewfinder as in claim 1, further comprising a transparent grid door carried by said frame and configured for being moved with respect to said frame, wherein said transparent grid door has a plurality of grid lines for creating a grid in said subject area.

8. A viewfinder, comprising:

a frame, said frame defining a window;

a first door carried by said frame and configured for being moved with respect to said frame, said first door positionable with respect to said frame so as to obstruct viewing through said window;

a second door carried by said frame and configured for being moved with respect to said frame, said second door positionable with respect to said frame so as to obstruct viewing through said window;

a reducing lens carried by said frame, said reducing lens configured to reduce the size of an image viewed through said window as compared to the size of the image viewed outside of said window;

a first transparent door carried by said frame and configured for being moved with respect to said frame, said first transparent door having a linear edge; and a second transparent door carried by said frame and configured for being moved with respect to said frame, said second transparent door having a linear edge;

wherein said first and second transparent doors are configured to be positioned with respect to one another such that said linear edges of said first and second transparent doors overlay and cross one another to form a grid having a cross-hair, wherein movement of said first transparent door with respect to said frame while keeping the position of said second transparent door with respect to said frame stationary causes said cross-hair of said grid to move with respect to said frame.

9. The viewfinder as in claim 8, wherein said window is rectangular in shape.

10. The viewfinder as in claim 8, wherein said first door and said second door are opaque, wherein said first door slides in a first direction with respect to said frame, wherein said second door slides in a second direction with respect to said frame, and wherein said first and said second directions are oriented at a ninety degree angle to one another.

11. The viewfinder as in claim 8, further comprising a light filter carried by said frame, said light filter configured for being moved with respect to said frame, said light filter positionable with respect to said frame so as to be configured for filtering out wavelengths of light from the image viewed through said window so as to more easily distinguish the color value of the image viewed through said window.

12. The viewfinder as in claim 8, wherein said linear edges of said first and second transparent doors are oriented at a ninety degree angle to one another.

13. The viewfinder as in claim 8, further comprising a transparent grid door carried by said frame and configured for being moved with respect to said frame, wherein said transparent grid door has a plurality of grid lines for creating a grid in said window.

14. A viewfinder, comprising:

a frame, said frame having a window for use by a user in viewing an image therethrough;

a reducing lens carried by said frame and disposed in said window, said reducing lens configured to reduce the size of an image viewed through said window as compared to the size of the image viewed outside of said window; and a grid carried by said frame and configured for being moved with respect to said frame so as to be positionable in said window, wherein said grid is formed by ends of a first transparent door and a second transparent door that are each configured for being moved with respect to said frame, wherein repositioning of said ends of said first transparent door and said second transparent door effects repositioning of said grid with respect to said frame.

15. The viewfinder as in claim 14, wherein said end of said first transparent door is a linear edge; and wherein said end of said second transparent door is a linear edge.

16. The viewfinder as in claim 15, wherein said first transparent door slides in a first direction with respect to said frame, wherein said second transparent door slides in a second direction with respect to said frame, and wherein said first direction and said second direction are oriented at a ninety degree angle to one another.

17. The viewfinder as in claim 14, wherein said grid is has a transparent grid door carried by said frame and is configured for being moved with respect to said frame, wherein said transparent grid door has a plurality of grid lines for creating a grid in said window.

18. The viewfinder as in claim 14, further comprising:

a first opaque door carried by said frame and configured for sliding in a first direction with respect to said frame, said first opaque door positionable with respect to said frame so as to obstruct viewing through said window; and a second opaque door carried by said frame and configured for sliding in a second direction with respect to said frame, said second opaque door positionable with respect to said frame so as to obstruct viewing through said window;

wherein said first direction and said second direction are oriented at a ninety degree angle to one another.

19. The viewfinder as in claim 14, further comprising a red light filter carried by said frame and configured for being moved with respect to said frame so as to be positionable in said window, said red light filter configured for filtering out wavelengths of light from the image so as to more easily distinguish the color value of the image viewed in said window.

* * * * *

UNITED STATES PATENT AND TRADEMARK OFFICE

CERTIFICATE OF CORRECTION

PATENT NO. : 7,401,410 B1
APPLICATION NO. : 11/448332
DATED : July 22, 2008
INVENTOR(S) : Russell P. Jewell It is certified that error appears in the above-identified patent and that said Letters Patent is hereby corrected as shown below:

In claim 17 at column 12, line 38, delete the word --is--.

Signed and Sealed this

Second Day of September, 2008

JON W. DUDAS
*Director of the United States Patent and Trademark Office*